US006126277A

United States Patent [19]

Feinn et al.

[11] Patent Number: 6,126,277

[45] Date of Patent: Oct. 3, 2000

[54] NON-KOGATING, LOW TURN ON ENERGY THIN FILM STRUCTURE FOR VERY LOW DROP VOLUME THERMAL INK JET PENS

[75] Inventors: James A. Feinn, San Diego, Calif.; William R. Knight, Corvallis, Oreg.

[73] Assignee: Hewlett-Packard Company, Palo Alto, Calif.

[21] Appl. No.: 09/069,393

[22] Filed: Apr. 29, 1998

[51] Int. Cl.[7] ..... B41J 2/05

[52] U.S. Cl. ..... 347/65; 347/62

[58] Field of Search ..... 347/62, 65, 63

[56] References Cited

U.S. PATENT DOCUMENTS

| | | | |
|---|---|---|---|
| 4,513,298 | 4/1985 | Scheu | 347/64 |
| 4,675,693 | 6/1987 | Yano | 347/65 X |
| 4,719,477 | 1/1988 | Hess . | |
| 5,198,834 | 3/1993 | Childers | 347/65 |
| 5,278,584 | 1/1994 | Keefe . | |
| 5,317,346 | 5/1994 | Garcia . | |
| 5,469,199 | 11/1995 | Allen . | |
| 5,912,685 | 6/1999 | Raman | 347/65 |

FOREIGN PATENT DOCUMENTS

| | | | |
|---|---|---|---|
| 0 317 171 A2 | 5/1989 | European Pat. Off. | B41J 3/04 |
| 0 401 996 A2 | 12/1990 | European Pat. Off. | B41J 2/05 |
| 0 47 5 235 A1 | 3/1992 | European Pat. Off. | B41J 2/205 |
| 0 688 672 A1 | 12/1995 | European Pat. Off. | B41J 2/16 |

OTHER PUBLICATIONS

European Search Report (dated: Jul. 29, 1999) for EP 98 12 4756.

"Development Of The Thin–Film Structure For The Think-Jet Printhead," Bhaskar & Aden, Hewlett–Packard Journal, vol. 36, No. 5, May 1985, pp. 27–33.

"Development Of A High–Resolution Thermal Inkjet Printhead," Buskirk, Hackleman, Hall, Kanarek, Low, Trueba, & Van de Poll, Hewlett–Packard Journal, vol. 39, No. 5, Oct. 1988, pp. 55–61.

"The Third–Generation HP Thermal InkJet Printhead," Aden, Bohorquez, Collins, Crook, Garcia & Hess, Hewlett–Packard Journal, vol. 45, No. 1, Feb. 1994, pp. 41–45.

*Primary Examiner*—John Barlow
*Assistant Examiner*—C. Dickens
*Attorney, Agent, or Firm*—Manuel Quiogue

[57] ABSTRACT

An ink jet printhead structure having a silicon carbide layer, an ink barrier layer disposed on the silicon carbide layer and respective ink chambers formed in the ink barrier layer over respective thin film resistors and adjacent the silicon carbide passivation layer, each chamber formed by a chamber opening in the ink barrier layer and a portion of the silicon carbide layer such that a silicon carbide surface fully extends across an area enclosed by the chamber opening, whereby a silicon carbide surface fully extends across the ink chamber. The ink chambers are more particularly configured to emit ink drops in the range of about 2 to 4 picoliters.

4 Claims, 3 Drawing Sheets

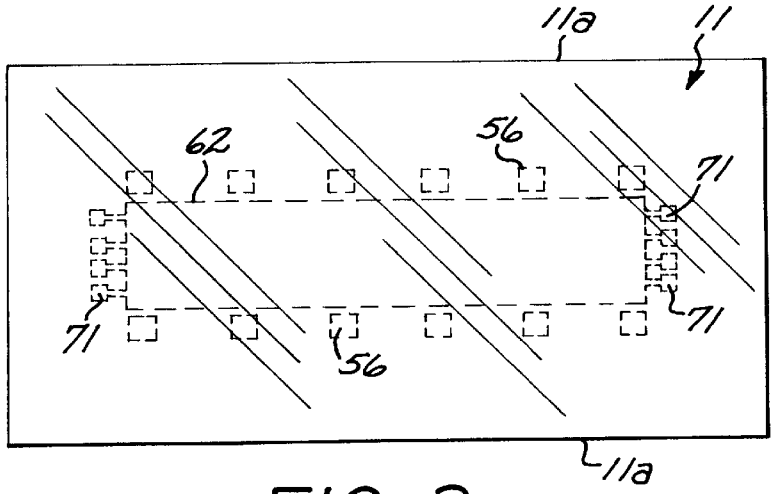
FIG. 2
FIG. 3
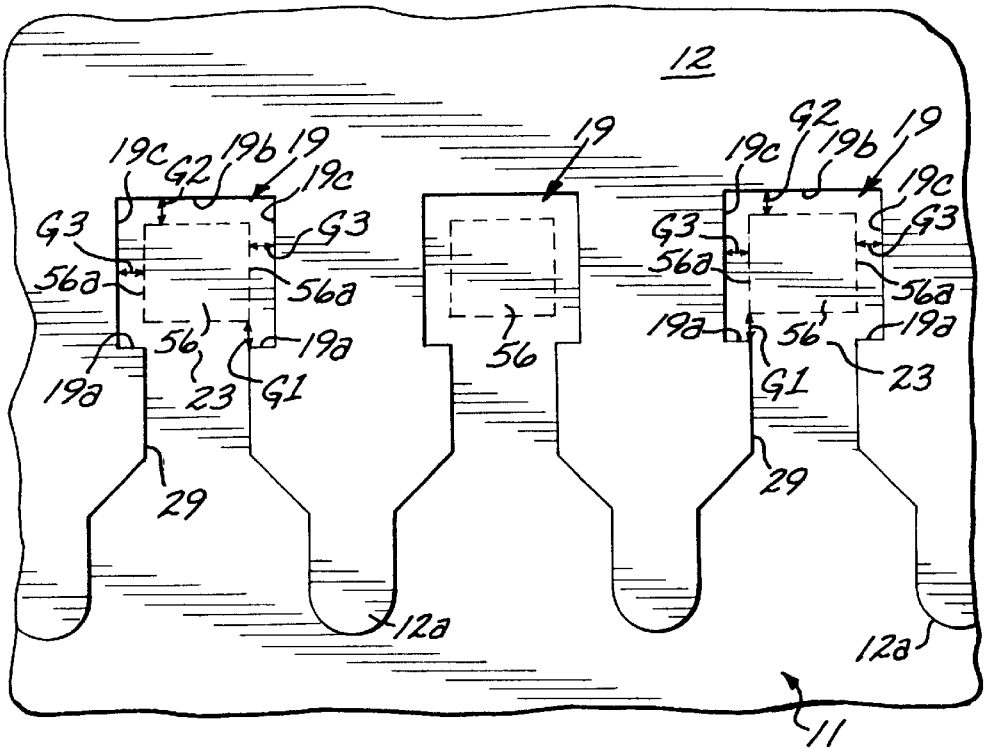

NON-KOGATING, LOW TURN ON ENERGY THIN FILM STRUCTURE FOR VERY LOW DROP VOLUME THERMAL INK JET PENS

BACKGROUND OF THE INVENTION

The subject invention generally relates to ink jet printing, and more particularly to a thin film ink jet printheads for ink jet cartridges and methods for manufacturing such printheads.

The art of ink jet printing is relatively well developed. Commercial products such as computer printers, graphics plotters, and facsimile machines have been implemented with ink jet technology for producing printed media. The contributions of Hewlett-Packard Company to ink jet technology are described, for example, in various articles in the *Hewlett-Packard Journal,* Vol. 36, No. 5 (May 1985); Vol. 39, No. 5 (October 1988); Vol. 43, No. 4 (August 1992); Vol. 43, No. 6 (December 1992); and Vol. 45, No. 1 (February 1994); all incorporated herein by reference.

Generally, an ink jet image is formed pursuant to precise placement on a print medium of ink drops emitted by an ink drop generating device known as an ink jet printhead. Typically, an ink jet printhead is supported on a movable print carriage that traverses over the surface of the print medium and is controlled to eject drops of ink at appropriate times pursuant to command of a microcomputer or other controller, wherein the timing of the application of the ink drops is intended to correspond to a pattern of pixels of the image being printed.

A typical Hewlett-Packard ink jet printhead includes an array of precisely formed nozzles in an orifice plate that is attached to an ink barrier layer which in turn is attached to a thin film substructure that implements ink firing heater resistors and apparatus for enabling the resistors. The ink barrier layer defines ink channels including ink chambers disposed over associated ink firing resistors, and the nozzles in the orifice plate are aligned with associated ink chambers. Ink drop generator regions are formed by the ink chambers and portions of the thin film substructure and the orifice plate that are adjacent the ink chambers.

The thin film substructure is typically comprised of a substrate such as silicon on which are formed various thin film layers that form thin film ink firing resistors, apparatus for enabling the resistors, and also interconnections to bonding pads that are provided for external electrical connections to the printhead. The thin film substructure more particularly includes a top thin film layer of tantalum disposed over the resistors as a thermomechanical passivation layer that protects against cavitation damage.

The ink barrier layer is typically a polymer material that is laminated as a dry film to the thin film substructure, and is designed to be photodefinable and both UV and thermally curable.

An example of the physical arrangement of the orifice plate, ink barrier layer, and thin film substructure is illustrated at page 44 of the *Hewlett-Packard Journal* of February 1994, cited above. Further examples of ink jet printheads are set forth in commonly assigned U.S. Pat. No. 4,719,477 and U.S. Pat. No. 5,317,346, both of which are incorporated herein by reference.

Color ink jet printers commonly employ a plurality of printheads mounted in the print carriage to produce a full spectrum of colors. For example, in a printer with four printheads, each printhead can provide a different color output, with the commonly used base colors being cyan, magenta, yellow and black. In a printer with two printheads, one printhead provides a black output, while the other provides cyan, magenta and yellow outputs from respective nozzle sub-arrays.

The base colors are produced on the media by depositing a drop of the required color onto a pixel location, while secondary or shaded colors are formed by depositing multiple drops of different base colors onto the same or an adjacent pixel location, with the overprinting of two or more base colors producing the secondary colors according to well established optical principles.

In order to achieve photographic-like quality color printing in four ink printing systems, ink drop volume needs to be reduced significantly, for example to about 3 picoliters, wherein non-photographic quality four ink systems commonly operate with a drop volume of about 30 picoliters. While the above-described ink jet printhead architecture has been adapted for reduced drop volumes by shrinking the resistor, chamber and nozzle dimensions, there is in the reduced size printhead architecture a significant increase in "kogation" which is the accumulation of a ink components that are tenaciously adhered to the tantalum passivation layer in the ink chambers. Such kogation layers reduce the heat transfer to the ink during a firing event, which in turn leads to smaller, slower, and often misdirected drops. Eventually, an affected nozzle will fail.

The problem of kogation at lower ink drop volumes has been addressed by alterations to ink chemistry such as the addition of anionic phosphates. However, the phosphate additions do not prevent kogation with many dyes, and force trade-offs in other ink attributes such as dry time, waterfastness and light fastness.

The problem of kogation has also been addressed by increasing drop volume relative to optimal drop volumes. This however causes unacceptable print quality degradation.

Accordingly, there is a need for a non-kogating low drop volume ink jet printhead.

SUMMARY OF THE INVENTION

The present invention is a thin film ink jet printhead that includes a thin film substrate having a plurality of thin film layers, a plurality of ink firing heater resistors defined in the plurality of thin film layers, a patterned silicon carbide layer disposed on the plurality of thin film layers over the thin film ink firing heater resistors, an ink barrier layer disposed on the silicon carbide passivation layer, and respective ink chambers formed in the ink barrier layer over respective thin film resistors and adjacent the silicon carbide passivation layer, wherein each chamber formed by a chamber opening in the barrier layer and a portion of the silicon carbide layer such that ink in each chamber is in contact with a silicon carbide surface.

The subject invention eliminates kogation by having an ink chamber with a silicon carbide surface over a heater resistor, and further significantly reduces the turn on energy of the printhead. Still further, the silicon carbide surface is a smoother surface (as compared to tantalum) that promotes reduction in drop volume variation and drop velocity variation, which results in better print quality. Also, the subject invention allows for increased ink formulation flexibility to optimize ink attributes that are necessary for achieving photographic quality images, since additives for reducing kogation are avoided.

BRIEF DESCRIPTION OF THE DRAWINGS

The advantages and features of the disclosed invention will readily be appreciated by persons skilled in the art from the following detailed description when read in conjunction with the drawing wherein:

FIG. 2 is an unscaled schematic top plan illustration of the general layout of the thin film substructure of the ink jet printhead of FIG. 1.

FIG. 3 is an unscaled schematic top plan view illustrating the configuration of a plurality of representative heater resistors, ink chambers and associated ink channels.

DETAILED DESCRIPTION OF THE DISCLOSURE

Figure 1:
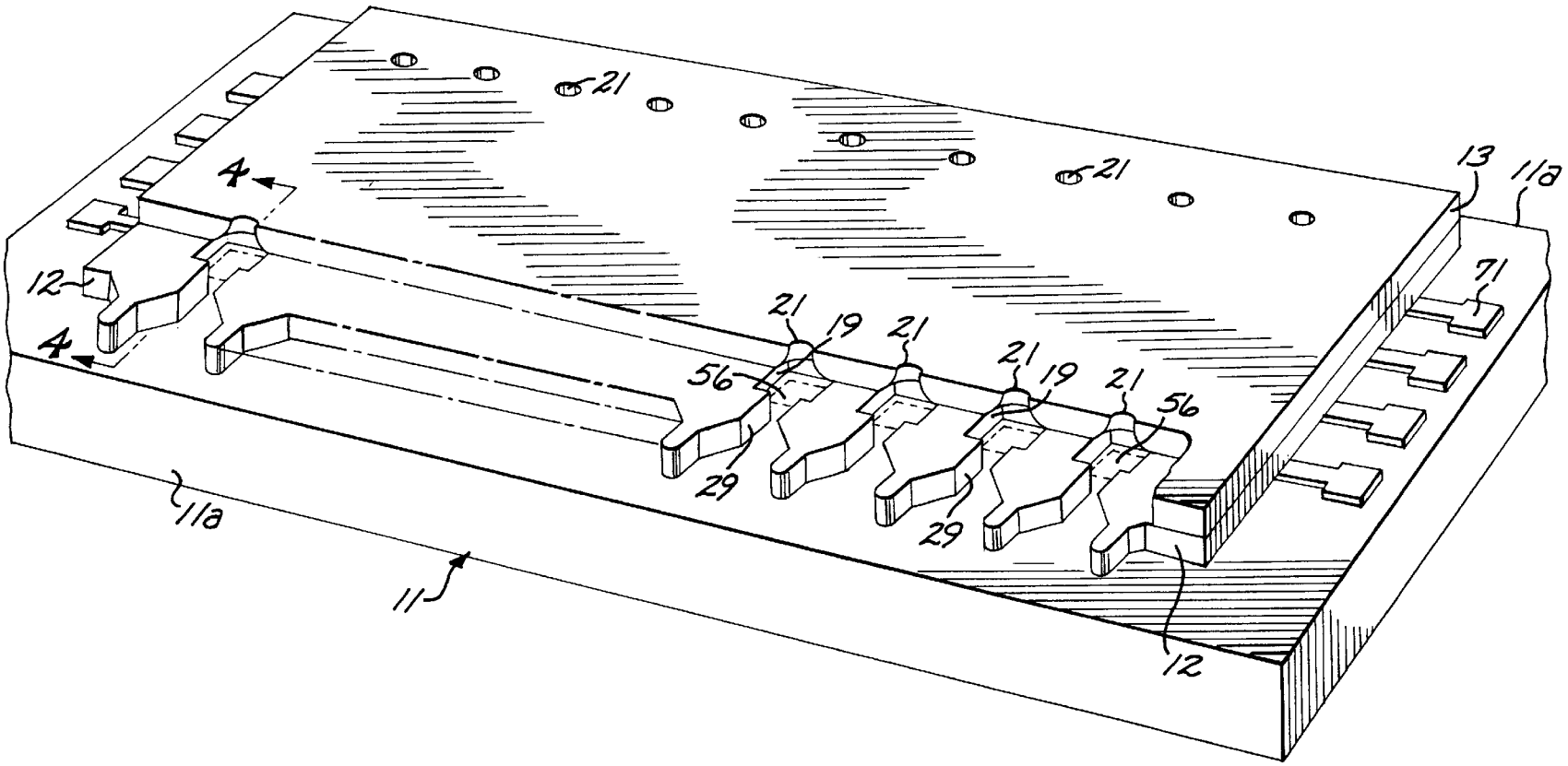
FIG. 1 is a schematic, partially sectioned perspective view of an ink jet printhead in accordance with the invention.

In the following detailed description and in the several figures of the drawing, like elements are identified with like reference numerals.

Referring now to FIG. 1, set forth therein is an unscaled schematic perspective view of an ink jet printhead in which the invention can be employed and which generally includes (a) a thin film substructure or die 11 comprising a substrate such as silicon and having various thin film layers formed thereon, (b) an ink barrier layer 12 disposed on the thin film substructure 11, and (c) an orifice or nozzle plate 13 attached to the top of the ink barrier 12 with a carbide adhesion layer 14.

The thin film substructure 11 is formed pursuant to conventional integrated circuit techniques, and includes thin film heater resistors 56 formed therein. By way of illustrative example, the thin film heater resistors 56 are located in rows along longitudinal edges of the thin film substructure.

The ink barrier layer 12 is formed of a dry film that is heat and pressure laminated to the thin film substructure 11 and photodefined to form therein ink chambers 19 and ink channels 29 which are disposed over resistor regions which are on either side of a generally centrally located gold layer 62 (FIG. 2) on the thin film substructure 11. Gold bonding pads 71 engagable for external electrical connections are disposed at the ends of the thin film substructure and are not covered by the ink barrier layer 12. As discussed further herein with respect to FIG. 2, the thin film substructure 11 includes a patterned gold layer 62 generally disposed in the middle of the thin film substructure 11 between the rows of heater resistors 56, and the ink barrier layer 12 covers most of such patterned gold layer 62, as well as the areas between adjacent heater resistors 56. By way of illustrative example, the barrier layer material comprises an acrylate based photopolymer dry film such as the "Parad" brand photopolymer dry film obtainable from E.I. duPont de Nemours and Company of Wilmington, Del. Similar dry films include other duPont products such as the "Riston" brand dry film and dry films made by other chemical providers. The orifice plate 13 comprises, for example, a planar substrate comprised of a polymer material and in which the orifices are formed by laser ablation, for example as disclosed in commonly assigned U.S. Pat. No. 5,469,199, incorporated herein by reference. The orifice plate can also comprise a plated metal such as nickel.

The ink chambers 19 in the ink barrier layer 12 are more particularly disposed over respective ink firing resistors 56, and each ink chamber 19 is defined by interconnected edges or walls 19*a*, 19*b*, 19*c* of a chamber opening formed in the barrier layer 12. The ink channels 29 are defined by further openings formed in the barrier layer 12, and are integrally joined to respective ink firing chambers 19. By way of illustrative example, FIG. 1 illustrates an outer edge fed configuration wherein the ink channels 29 open towards an outer edge 11*a* formed by the outer perimeter of the thin film substructure 11 and ink is supplied to the ink channels 29 and the ink chambers 19 around the outer edges 11*a* of the thin film substructure, for example as more particularly disclosed in commonly assigned U.S. Pat. No. 5,278,584, incorporated herein by reference, whereby the outer edges hla around which ink flows form outer feed edges. The invention can also be employed in a center edge fed ink jet printhead such as that disclosed in previously identified U.S. Pat. No. 5,317,346, wherein the ink channels open towards an edge formed by a slot in the middle of the thin film substructure, whereby the edge of the slot forms a center feed edge.

The orifice plate 13 includes orifices or nozzles 21 disposed over respective ink chambers 19, such that an ink firing resistor 56, an associated ink chamber 19, and an associated orifice 21 are aligned. An ink drop generator region is formed by each ink chamber 19 and portions of the thin film substructure 11 and the orifice plate 13 that are adjacent the ink chamber 19.

Referring now to FIG. 2, set forth therein is an unscaled schematic top plan illustration of the general layout of the thin film substructure 11. The ink firing resistors 56 are formed in resistor regions that are adjacent longitudinal outer edges 11*a* of the thin film substructure 11 which form outer feed edges. A patterned gold layer 62 comprised of gold traces forms the top layer of the thin film structure in a gold layer region 162 located generally in the middle of the thin film substructure 11 between the resistor regions and extending between the ends of the thin film substructure 11. Bonding pads 71 for external connections are formed in the patterned gold layer 62, for example adjacent the ends of the thin film substructure 11. The ink barrier layer 12 is defined so as to cover all of the patterned gold layer 62 except for the bonding pads 71, and also to cover the areas between the respective openings that form the ink chambers and associated ink channels. Depending upon implementation, one or more thin film layers can be disposed over the patterned gold layer 62.

Referring now to FIG. 3, set forth therein is an unscaled schematic top plan view illustrating the configuration of a plurality of representative heater resistors 56, ink chambers 19 and associated ink channels 29. The heater resistors 56 are polygon shaped (e.g., rectangular) with multiple resistor sides or edges 56*a*, and are enclosed on at least two sides thereof by the walls of an ink chamber 19 which for example is particularly formed of front walls 19*a* that are on either side of a feed opening 23, a rear wall 19*b* opposite the front walls 19*a*, and opposing side walls 19*c* disposed between the front wall sections 19*a* and the rear wall 19*b*. The resistor edges 56*a* are displaced inwardly from chamber walls by gaps G1, G2, G3, wherein the gap G1 is the distance from the front walls 19*a* to an adjacent resistor edge, the gap G2 is the distance from the rear wall 19 to an adjacent resistor edge, and the gap G3 is the distance from a side wall 19 to an adjacent resistor edge.

The ink channels 29 extend away from feed openings 23 of associated ink chambers 19 and can become wider at some distance from the ink chambers 19. Insofar as adjacent ink channels 29 generally extend in the same direction, the portions of the ink barrier layer 12 that form the openings that define ink chambers 19 and ink channels 29 thus form an array of barrier tips 12*a* that extend toward an adjacent feed edge of the thin film substructure 11 from a central portion of the barrier layer 12 that covers the patterned gold layer 62 and is on the side of the heater resistors 56 away from the adjacent feed edge. Stated another way, ink chambers 19 and associated ink channels 29 are formed by an array of side by side barrier tips 12*a* that extend from a central portion of the ink barrier 12 toward a feed edge of the thin film substructure 11.

In accordance with the invention, as discussed more fully herein, the thin film substructure 11 includes an upper silicon carbide layer that is contact with the ink barrier layer 12 in at least the regions in which the ink chambers 19 are located, such that each ink chamber includes a silicon carbide surface that fully and completely extends across the ink chamber. That is, each ink chamber includes a silicon carbide surface that extends completely across an area that is enclosed by the opening in the ink barrier, wherein the area is defined by the edge of the interface between the ink barrier and silicon carbide layer. In contrast to known printhead structures, the interior of each ink chamber is completely devoid of tantalum. Further in accordance with the invention, the printhead is configured to produce a drop volume in the range of 2 to 4 picoliters.

Figure 4:
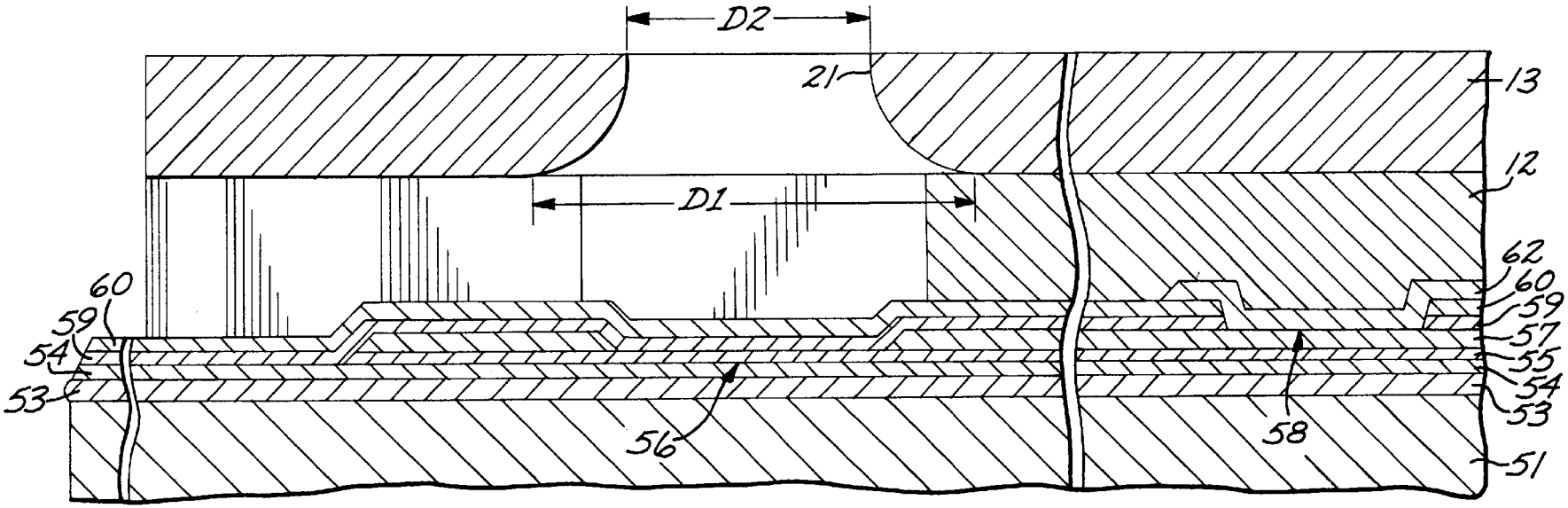
FIG. 4 is an unscaled schematic cross sectional view of the ink jet printhead of FIG. 1 taken laterally through a representative ink drop generator region and illustrating an embodiment of the printhead of FIG. 1.

Referring now to FIG. 4, set forth therein is an unscaled schematic cross sectional view of the ink jet printhead of FIG. 1 taken through a representative ink drop generator region and a portion of the centrally located gold layer region 162, and illustrating a specific embodiment of the thin film substructure 11. The thin film substructure 11 of the ink jet printhead of FIG. 4 more particularly includes a silicon substrate 51, a field oxide layer 53 disposed over the silicon substrate 51, and a patterned phosphorous doped oxide layer 54 disposed over the field oxide layer 53. A resistive layer 55 comprising tantalum aluminum is formed on the phosphorous oxide layer 54, and extends over areas where thin film resistors, including ink firing resistors 56, are to be formed beneath ink chambers 19. A patterned metallization layer 57 comprising aluminum doped with a small percentage of copper and/or silicon, for example, is disposed over the resistor layer 55.

The metallization layer 57 comprises metallization traces defined by appropriate masking and etching. The masking and etch of the metallization layer 57 also defines the resistor areas. In particular, the resistive layer 55 and the metallization layer 57 are generally in registration with each other, except that portions of traces of the metallization layer 57 are removed in those areas where resistors are formed. In this manner, the conductive path at an opening in a trace in the metallization layer includes a portion of the resistive layer 55 located at the opening or gap in the conductive trace. Stated another way, a resistor area is defined by providing first and second metallic traces that terminate at different locations on the perimeter of the resistor area. The first and second traces comprise the terminal or leads of the resistor which effectively include a portion of the resistive layer that is between the terminations of the first and second traces. Pursuant to this technique of forming resistors, the resistive layer 55 and the metallization layer can be simultaneously etched to form patterned layers in registration with each other. Then, openings are etched in the metallization layer 57 to define resistors. The ink firing resistors 56 are thus particularly formed in the resistive layer 55 pursuant to gaps in traces in the metallization layer 57.

A composite passivation layer comprising a layer 59 of silicon nitride ($Si_3N_4$) and a layer 60 of silicon carbide (SiC) is disposed over the metallization layer 57, the exposed portions of the resistive layer 55, and exposed portions of the oxide layer 53.

The following table sets forth exemplary nominal feature dimensions for a typical printhead in accordance with the invention.

| | |
|---|---|
| polymer orifice plate thickness | 25.4 ± 2.5 micrometers ($\mu$m) |
| ink barrier thickness | 14 ± 1.5 $\mu$m |
| silicon carbide thickness | 0.25 ± .015 $\mu$m |
| silicon nitride thickness | 0.125 ± .03 $\mu$m |
| tantalum/aluminum resistivity | 28.5 ± 2.2 ohms per unit area |
| heater resistor edges adjacent front walls 19a and rear wall 19a | 17 ± .75 $\mu$m |
| heater resistor edges adjacent side walls 19c | 17 ± 1.5 $\mu$m |
| resistor edge to chamber wall gaps G1, G2, G3 (FIG. 3) | 5 ± 2 $\mu$m |
| chamber area on silicon carbide, as defined by the walls 19a, 19b, 19c and an imaginary wall drawn between the walls 19a | about 22 $\mu$m by about 22 $\mu$m square |
| nozzle entrance diameter D1 (FIG. 4) | 34 ± 3 $\mu$m |
| nozzle exit diameter D2 (FIG. 4) | 12 ± 1 $\mu$m |

The foregoing printhead is readily produced pursuant to standard thin film integrated circuit processing including chemical vapor deposition, photoresist deposition, masking, developing, and etching, for example as disclosed in commonly assigned U.S. Pat. No. 4,719,477 and U.S. Pat. No. 5,317,346, both previously incorporated herein by reference.

By way of illustrative example, the foregoing structures can be made as follows. Starting with the silicon substrate 51, any active regions where transistors are to be formed are protected by patterned oxide and nitride layers. Field oxide 53 is grown in the unprotected areas, and the oxide and nitride layers are removed. Next, gate oxide is grown in the active regions, and a polysilicon layer is deposited over the entire substrate. The gate oxide and the polysilicon are etched to form polysilicon gates over the active areas. The resulting thin film structure is subjected to phosphorous predeposition by which phosphorous is introduced into the unprotected areas of the silicon substrate. A layer of phosphorous doped oxide 54 is then deposited over the entire in-process thin film structure, and the phosphorous doped oxide coated structure is subjected to a diffusion drive-in step to achieve the desired depth of diffusion in the active areas. The phosphorous doped oxide layer is then masked and etched to open contacts to the active devices.

The tantalum aluminum resistive layer 55 is then deposited, and the aluminum metallization layer 57 is subsequently deposited on the tantalum aluminum layer 55. The aluminum layer 57 and the tantalum aluminum layer 55 are etched together to form the desired conductive pattern. The resulting patterned aluminum layer is then etched to open the resistor areas.

The silicon nitride passivation layer 59 and the SiC passivation layer 60 are respectively deposited. A photoresist pattern which defines vias to be formed in the silicon nitride and silicon carbide layers 59, 60 is disposed on the silicon carbide layer 60, and the thin film structure is subjected to overetching, which opens vias through the composite passivation layer comprised of silicon nitride and silicon carbide to the aluminum metallization layer. The gold layer 62 for external connections is then suitably deposited and etched. The ink barrier layer 12 is heat and pressure laminated onto the thin film substructure, and the orifice plate 13 is laminated onto the ink barrier layer 12.

The foregoing has been a disclosure of a low drop volume thermal ink jet printhead that advantageously eliminates detrimental accumulation of ink components on the ink chamber surface adjacent the heater resistor.

As a result of eliminating kogation, the disclosed thermal ink jet printhead allows for greater flexibility in optimizing ink attributes, since ink formulation does not have to be compromised to address kogation.

The disclosed thermal ink jet printhead further provides for dramatically reduced resistor turn on energy, which advantageously results in lower operating temperatures and smaller drop volumes, and which allows for less expensive power supplies. Typically, turn on energy is reduced in the range of about 25 percent to 45 percent.

The disclosed thermal ink jet printhead also provides for reduced drop to drop volume variation and reduced drop velocity variation, which leads to better drop placement, which in turn improves image quality.

Although the foregoing has been a description and illustration of specific embodiments of the invention, various modifications and changes thereto can be made by persons skilled in the art without departing from the scope and spirit of the invention as defined by the following claims.

What is claimed is:

1. A very low drop volume thin film ink jet printhead, comprising:

a thin film substrate including a plurality of thin film layers;

a plurality of tantalum aluminum ink firing heater resistors defined in said plurality of thin film layers, each of said resistors being a square of about 17 micrometers by 17 micrometers;

a silicon carbide layer disposed on said plurality of thin film layers over said tantalum aluminum ink firing heater resistors;

an ink barrier layer disposed on said silicon carbide layer;

respective ink chambers formed in said ink barrier layer over respective tantalum aluminum ink firing resistors and adjacent said silicon carbide layer, each chamber formed by a chamber opening in said barrier layer and a portion of said silicon carbide layer such that a silicon carbide surface fully extends across an area enclosed by said chamber opening, said area being about 22 micrometers by 22 micrometers;

said ink chambers being configured to emit ink drops in the range of about 2 to 4 picoliters; and an orifice plate having nozzle orifices disposed over said ink barrier layer, said orifices having an entrance diameter of about 34 micrometers and an exit diameter of about 12 micrometers;

whereby detrimental accumulation of ink components on said silicon carbide surface is avoided, variation in drop to drop volume is reduced, and variation in drop velocity is reduced.

2. The thin film ink jet printhead of claim 1 wherein said silicon carbide layer has a thickness of about 0.25 micrometers.

3. The thin film ink jet printhead of claim 1 wherein said ink barrier layer has a thickness of about 14 micrometers.

4. The thin film ink jet printhead of claim 1 wherein said orifice plate has a thickness of about 25.4 micrometers.

* * * * *